US005132082A

United States Patent [19]

Simkovich et al.

[11] Patent Number: 5,132,082

[45] Date of Patent: Jul. 21, 1992

[54] PROCESS FOR REDUCING THE OXYGEN POTENTIAL OF AN INERT PROCESSING ATMOSPHERE

[75] Inventors: George Simkovich; Ming-Chuan Lee, both of State College, Pa.

[73] Assignee: The Pennsylvania Research Corporation, University Park, Pa.

[21] Appl. No.: 713,901

[22] Filed: Jun. 12, 1991

[51] Int. Cl.[5] ..... G22F 1/00

[52] U.S. Cl. ..... 419/57; 419/58; 264/65; 420/590

[58] Field of Search ..... 419/57, 58; 420/590; 264/65

[56] References Cited

U.S. PATENT DOCUMENTS 4,018,901 4/1977 Hayward et al. ..... 426/72

4,108,728 8/1978 Spinner et al. ..... 422/190

*Primary Examiner*—Stephen J. Lechert, Jr.

*Attorney, Agent, or Firm*—Thomas J. Monahan

[57] ABSTRACT

A method for lowering the oxygen potential of an inert processing atmosphere containing a reducing gas such as hydrogen, by introducing a metal catalyst to induce reaction between the reducing gas and oxygen, which may originate from leaks into the system or from other sources. The catalyst, such as a precious metal, increases the rate of reaction between gaseous hydrogen and gaseous oxygen to form water vapor, thereby decreasing the amount of molecular oxygen available to react with oxidizable materials exposed to the inert processing atmosphere.

12 Claims, 2 Drawing Sheets

OXIDATION CURVES OF Cu-Be ALLOY AT 1050°F (566°C) IN $H_2/N_2$ GAS MIXTURES.

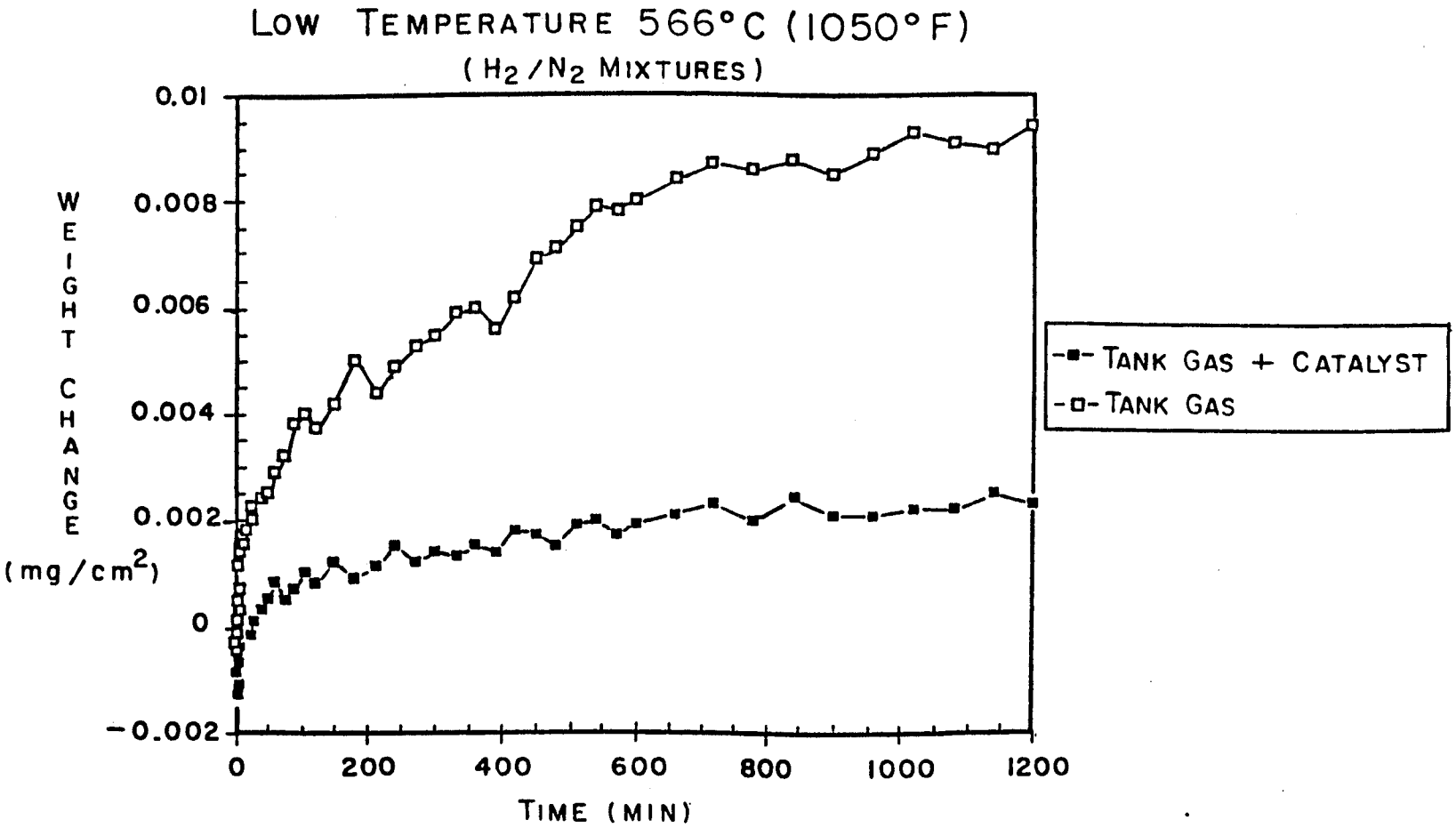
FIGURE 1: OXIDATION CURVES OF Cu-Be ALLOY AT 1050°F (566°C) IN $H_2/N_2$ GAS MIXTURES.

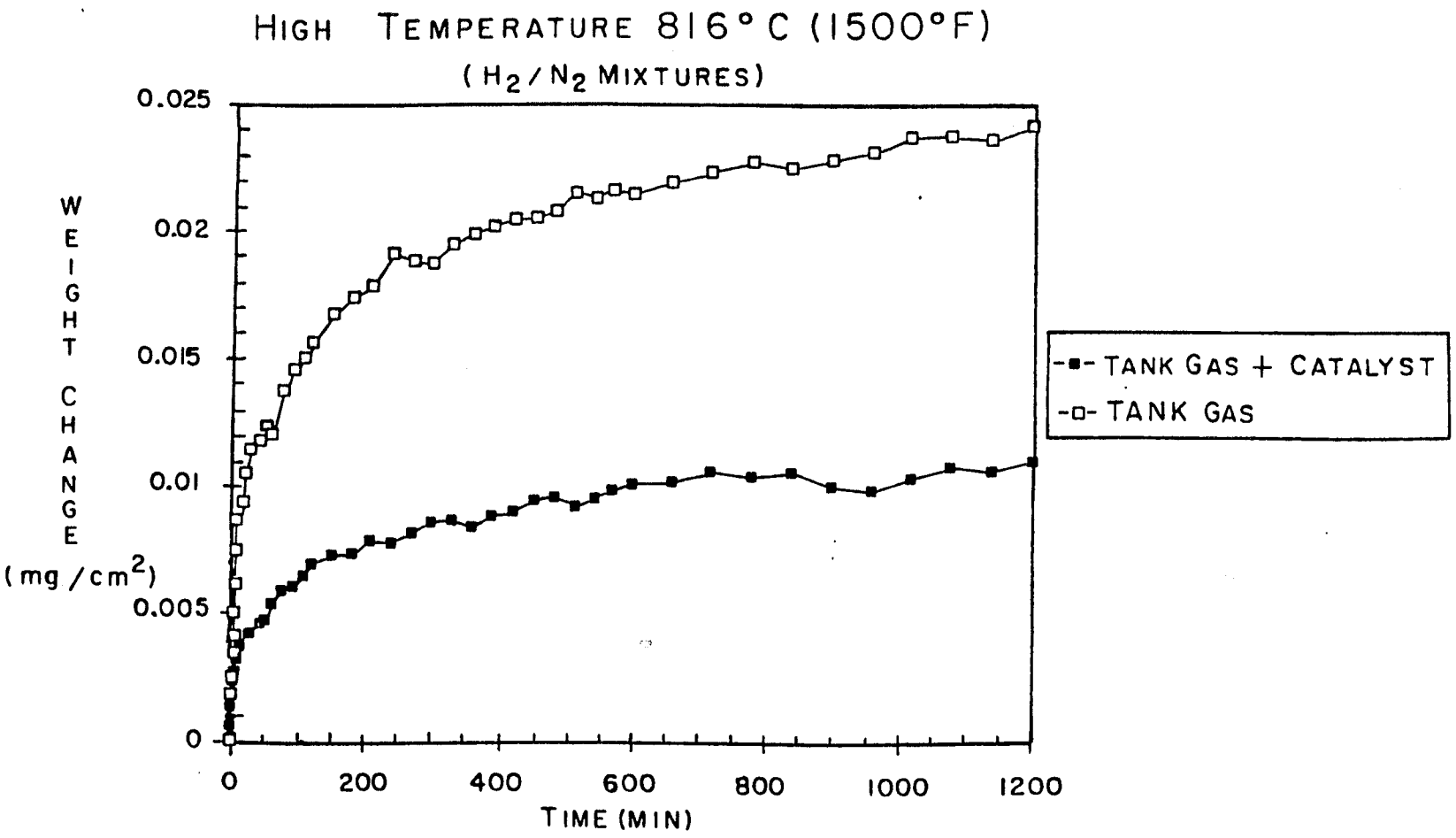
FIGURE 2: OXIDATION CURVES OF Cu-Be ALLOY AT 1500°F (816°C) IN $H_2/N_2$ GAS MIXTURES.

PROCESS FOR REDUCING THE OXYGEN POTENTIAL OF AN INERT PROCESSING ATMOSPHERE

BACKGROUND OF THE INVENTION

1. Field of the Invention

The present invention relates to an improved process for reducing the amount of molecular oxygen present in an inert processing atmosphere. In many known processes, such as the preparation or processing of pure metals, metal alloys, ceramics and/or semiconductors, it is conventional to conduct the process in an inert atmosphere in order to shield the reaction and/or materials against unwanted oxidation. While this is effective for most processes, it is not satisfactory in cases where even the formation of minor amounts of oxide impurities cannot be tolerated, which oxide impurities can result from the presence of small or trace amounts of oxygen which can be absorbed or adsorbed in the system or in the materials being processed.

2. Discussion of the Prior Art

It is conventional to form and sinter some metals, metal alloys, ceramics and/or semiconductors in an inert reducing atmosphere in order to prevent unwanted oxidation reactions, and reference is made to U.S. Pat. Nos. 3,196,007 and 4,088,475. It is also known to incorporate scavenger compounds which absorb or react with any oxygen present in the system, or to include compounds which develop reducing gases for reaction with any oxygen present in the system, and reference is made to U.S. Pat. Nos. 3,992,200 and 3,050,386.

The prior art evidences the fact that even an inert reducing atmosphere does not provide absolute protection against the presence of molecular oxygen. When a reducing gas such as hydrogen is present in the protective inert gas, the reaction atmosphere will contain $H_2$, water vapor and, if equilibrium is attained, an oxygen potential corresponding to the $H_2/H_2O$ ratio at the existing temperature and pressure. Unfortunately such atmospheres are not completely effective for preventing oxidation. Firstly, there is always at least a small amount of oxygen gas present in an inert gas system, which oxygen potential can be diminished but not eliminated by incorporating hydrogen gas, provided that system and the reactants will not suffer from the presence of hydrogen and/or water vapor. Secondly, the reaction between hydrogen and oxygen does not always proceed to equilibrium, and may result in an oxygen potential which is much higher than if equilibrium is obtained.

SUMMARY OF THE INVENTION

The present invention relates to improvements in processes which require an inert reducing atmosphere to protect an oxidizable material being processed against oxidation, and is characterized by lowering the oxygen potential of the inert atmosphere by the inclusion of one or more metal reduction catalysts capable of producing an oxygen equilibrium by increasing the rate of reaction between the hydrogen gas and any gaseous oxygen present in the reaction atmosphere at temperatures between about 20° C. and 1,000° C., preferably above about 100° C. According to the invention it has been discovered that the use of a processing atmosphere comprising an inert gas and hydrogen gas, in combination with the present metal reduction catalysts, unexpectedly reduces oxidation of an oxidizable product being processed by a factor of from more than about 2 times up to more than about 4 times, depending upon the processing time and temperature, as compared to the same processes carried out in an identical atmosphere comprising the inert gas and hydrogen in the absence of the metal reduction catalyst.

More specifically, in the processing of copper-beryllium alloy 25 at temperatures of 566° C.(1,050° F.) and 816° C.(1,500° F.), using a processing atmosphere of $H_2/N_2$, the inclusion of a metal reduction catalyst, such as a noble metal, substantially reduces the formation of oxides in the H atmosphere. Cu-Be alloy 25 is a commercial alloy consisting of 1.8 wt % beryllium, 0.2 wt % cobalt or nickel, balance copper, which can be processed at relatively low temperatures in the area of about 566° C.(1,050° F.) or at relatively high temperatures of about 816° C.(1,500° F.) in an inert reducing atmosphere such as a mixture of nitrogen gas and hydrogen gas. Experiments illustrate that such alloy oxidizes under such conditions over a period of 20 hours, as evidenced by an increase in the weight of the alloy due to the formation of BeO and copper oxide(s), by nearly 0.01 $mg/cm^2$ at 1,050° F. and by nearly 0.025 $mg/cm^2$ at 1,500° F.

However the inclusion of a metal reduction catalyst, such as platinum, increases the rate of reaction between the gaseous $H_2$ and gaseous oxygen, which is present in trace amounts in the system, to lower the oxygen potential in the reaction atmosphere, whereby the amount of free oxygen available to oxidize the metals of the alloy is reduced substantially and the weight of the oxide impurities formed is lowered by a factor of more than 4½ times at the lower temperature (1,050° F.) and by a factor of over 3 times at the higher temperature (1,500° F.) after an exposure period of 200 minutes.

THE DRAWINGS

FIG. 1 and 2 are time/temperature charts illustrating oxidation curves for Cu-Be alloy 25 exposed to temperatures of 1,050° F. and 1,500° F., respectively, under identical $H_2/N_2$ atmospheres, comparing the relative weight increases in the absence of and in the presence of a platinum catalyst according to the present invention.

DETAILED DESCRIPTION

The present invention is based upon the discovery that reaction or processing systems which require an inert reducing atmosphere in order to protect the oxidizable materials being produced or processed against oxidation by even trace amounts of oxygen gas, can be rendered substantially more effective by the inclusion of a metal catalyst which catalyzes the rate of reaction between the reducing gas and the gaseous oxygen present in the reaction atmosphere to reduce the oxygen available to oxidize the materials being reacted or processed.

Certain metals, alloys and mixtures thereof are well known for use in gaseous reduction reactions, as take place in automotive catalytic converters, for example. The most commonly-used reducing metal catalysts are the precious metals including platinum, palladium, rhodium, iridium, ruthenium and alloys thereof. Also used are more common metals such as iron, cobalt, nickel, and the like. Alloys, binary mixtures and multicomponent mixtures of such metals are also conventionally used in reducing systems. However, it was not known that the inclusion of such catalysts in a system comprising an inert protective atmosphere would produce a synergistic effect by reducing the oxidization reaction to a greater extent than possible using either the catalyst or the reducing atmosphere alone.

The suitable inert gas atmosphere is one which is inert which respect to the materials being reacted or processed, such as alloys being sintered. A preferred inert gas is nitrogen but other useful gases include argon, helium, and neon. The inert gas may include from about 0.1% to about 60% by volume of hydrogen gas, for reaction with small amounts of oxygen gas which leaks into the system or is absorbed, adsorbed or otherwise present in the reactants or in the materials being processed. The $H_2/N_2$ mixture is inert with respect to the reactants and/or products being processed but is selectively reactive with the gaseous oxygen because of the presence of hydrogen.

According to the present invention, the heated mixture of the inert gas and hydrogen may be circulated into the processing chamber containing the catalyst and the materials being processed, or may be circulated through a catalyst chamber or previous catalyst member to reduce the oxygen content of the $H_2/N_2$ atmosphere, then passed through a drying chamber before entering the processing chamber containing only the materials being processed. In either case the $H_2/N_2$ gas may be continuously circulated out of the processing chamber, dried to remove water vapor, and fortified with additional hydrogen gas if necessary, before recirculation back into the catalyst chamber and the processing chamber.

The amount of the metal catalyst should be in accordance with standard practice for the catalyst used, the gas flow and temperature. Such standard practice is discussed in the article "Afterburner Catalyst-Effect of Heat And Mass Transfer Between Gas And Catalyst Surface", by R.D. Hawthorn, in the publication "Recent Advances In Air Pollution Control" edited by Coughlin et al., AIChE Symposium Series, No. 137, Vol. 70, pp. 428–438 (1974).

The $H_2/N_2$ atmosphere may be heated, passed through a catalytic chamber to reduce the $O_2$ potential, and through a drying chamber to reduce the water vapor content before introducing the $H_2/N_2$ to the processing chamber. Alternatively the catalytic chamber and processing chamber may be the same as long as the temperature is not excessive. In the latter embodiment, the $H_2/N_2$ atmosphere preferably is continuously circulated out of the processing chamber and dried, to remove water vapor formed by the reaction between $H_2$ and $O_2$, before recirculation back into the catalytic processing chamber. Preferably the catalyst is present in the form of a porous fabric or screen through which the $H_2/N_2$ gas mixture is circulated to catalyze the H reaction and reduce the $O_2$ potential of the entire gas mixture continuously.

While it will be apparent to those skilled in the art that the present invention is useful in connection with any system which incorporates an inert reducing gas atmosphere such as hydrogen, ammonia, etc., as a shielding means against oxidation, the invention is illustrated herein and in the accompanying drawings in connection with a system used for the processing of a copper-beryllium alloy 25 which consists of 1.8 wt % Be, 0.2 wt % Co or Ni, balance Cu.

In the commercial production of such alloys, an inert nitrogen gas atmosphere is used containing about 3.0% hydrogen to prevent oxidation of the alloy at the temperatures employed. A low temperature process employs a temperature of 1,050° F., and a high temperature process employs a temperature of 1,500° F.

As illustrated by the oxidation curves of FIGS. 1 and 2, the Cu-Be alloy undergoes a weight increase of from about 0.0046mg/cm$^2$ after 200 minutes, to about 0.0095 mg/cm$^2$ after about 1,200 minutes (20 hours) at 1,050° F., in the absence of the metal catalyst, and undergoes a weight increase of from about 0.018 mg/cm$^2$ after 200 minutes to about 0.024 mg/cm$^2$ after 1,200 minutes at 1,500° F. in the absence of the metal catalyst. Such weight increase is solely the result of the formation of oxides of beryllium and copper due to the small but important content of oxygen gas in the reaction atmosphere. While such small oxide contents may be relatively unimportant to many uses of the Cu-Be alloy, they are detrimental to many other uses which require that the alloy be as free of oxide content as possible.

The advantages of the present process are clearly illustrated by the comparative oxidation curves of FIGS. 1 and 2 illustrating the substantially- and unexpectedly-reduced weight change which occurs under conditions which are identical except for the presence of a metal reducing catalyst, specifically a platinum catalyst.

In all cases the weight changes were monitored by an automatic recording balance during the experiments.

The comparative weight increases illustrated by FIG. 1 (1,050° F.) are about 0.001 vs 0.0046 mg/cm$^2$ at 200 minutes (a 4.6-fold reduction), 0.0015 vs 0.0057 mg/cm$^2$ at 400 minutes (a 3.8-fold reduction), 0.002 vs 0.008 at 600 minutes (a 4-fold reduction), 0.0023 vs 0.0085 mg/cm$^2$ at 800 minutes (a 3.7-fold reduction), 0.0025 vs 0.009 mg/cm$^2$ at 1,000 minutes (a 3.6-fold reduction), and 0.0025 vs 0.0095 mg/cm$^2$ at 1,200 minutes (a 3.8-fold reduction).

The comparative weight increases illustrated by FIG. 2 (1,500° F.) are about 0.0058 vs 0.018 mg/cm$^2$ at 200 minutes (a 3.1-fold reduction), 0.0059 vs 0.02 mg/cm$^2$ at 400 minutes (a 3.4-fold reduction), 0.01 vs. 0.022mg/cm at 600 minutes (a 2.2-fold increase), 0.011 vs 0.023 mg/cm$^2$ at 800 minutes (a 2.1 fold reduction), 0.011 vs 0.024 mg/cm$^2$ at 100 minutes (a 2.2-fold reduction) and 0.011 vs 0.0245 mg/cm$^2$ at 1,200 minutes (a 2.23-fold reduction).

These results, particularly the magnitude of the improvement provided by the inclusion of the present metal reduction catalysts, are completely unexpected and unobvious from the knowledge of the art of oxidation-resistant systems incorporating an inert gas shielding atmosphere.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

We claim:

1. Process for reducing the oxygen potential of a reducing gas atmosphere consisting essentially of an inert gas, a minor amount of an inert reducing gas and trace amounts of oxygen gas, which comprises exposing said gas atmosphere to a metal catalyst to increase the rate of reaction between said reducing gas and oxygen and thereby reduce the content of oxygen gas in said atmosphere.

2. Process according to claim 1 in which said gas atmosphere contains from about 0.1% to about 60% by volume of hydrogen gas as said reducing gas, which reacts with said oxygen gas to form water vapor.

3. Process according to claim 1 in which said metal reducing catalyst comprises a noble metal or an alloy thereof.

4. Process according to claim 3 in which said noble metal comprises platinum.

5. Process according to claim 1 in which said gas atmosphere is heated to a temperature above about 100° C.

6. Process according to claim 1 in which said gas atmosphere is exposed to said metal catalyst in a catalytic chamber, and the oxygen-reduced gas atmosphere is then conveyed to a processing chamber containing oxidizable materials to be processed in said atmosphere.

7. Process according to claim 6 in which said reducing gas is hydrogen, and the oxygen-reduced gas atmosphere is dried to remove the water vapor reaction product prior to being conveyed to said processing chamber.

8. Process according to claim 7 in which said gas atmosphere is continuously recirculated from said processing chamber back to said catalytic chamber.

9. Process according to claim 1 in which said gas atmosphere is exposed to said metal catalyst in a processing chamber containing oxidizable materials to be processed in said gas atmosphere containing the reduced content of oxygen.

10. Process according to claim 9 in which said materials to be processed comprise an oxidizable metal, metal alloy, oxidizable ceramic or oxidizable semiconductor composition.

11. Process according to claim 10 in which said oxidizable metal comprises a copper alloy.

12. Process according to claim 11 in which said copper alloy comprises Cu-Be alloy.

* * * * *